US005519981A

United States Patent [19]

Fukusaki

[11] Patent Number: 5,519,981

[45] Date of Patent: May 28, 1996

[54] TWIST-WRAPPING MACHINE

[75] Inventor: Hiroaki Fukusaki, Sakai, Japan

[73] Assignee: Tenchi Kikai Kabushiki, Osaka, Japan

[21] Appl. No.: 288,600

[22] Filed: Aug. 10, 1994

[30] Foreign Application Priority Data

Sep. 6, 1993 [JP] Japan ..... 5-221349
Mar. 15, 1994 [JP] Japan ..... 6-071501

[51] Int. Cl.[6] ..... B65B 11/34; B65B 7/12

[52] U.S. Cl. ..... 53/370; 53/234; 53/227; 221/233

[58] Field of Search ..... 221/233; 53/138.8, 53/217, 227, 234, 370

[56] References Cited

U.S. PATENT DOCUMENTS

| | | | |
|---|---|---|---|
| 1,955,493 | 4/1934 | Grover | 53/234 |
| 2,723,516 | 11/1955 | Malhiot | 53/234 |
| 2,744,370 | 5/1956 | Seragnoli | 53/227 |
| 2,938,320 | 5/1960 | Lesch | 53/370 |
| 3,011,678 | 12/1961 | McClosky et al. | 221/233 |
| 3,899,865 | 8/1975 | Revaz | 53/234 |
| 3,987,605 | 10/1976 | Johnson | 53/370 |
| 4,020,608 | 5/1977 | Seragnoli | 53/234 |
| 4,352,264 | 10/1982 | Seragnoli | 53/234 |
| 5,016,421 | 5/1991 | Ferrero | 53/227 |

FOREIGN PATENT DOCUMENTS

| | | | |
|---|---|---|---|
| 771055 | 3/1957 | United Kingdom | 53/234 |

*Primary Examiner*—W. Donald Bray
*Attorney, Agent, or Firm*—Lockwood Alex FitzGibbon & Cummings

[57] ABSTRACT

A twist-wrapping machine comprising an aligner for aligning candies in compartments of a rotary disk, a takeout means having a pushup member adapted to pass through the compartments and take out the candy in an upward direction, a paper feeder which supplies wrapping paper on top of the candy so taken out, a fork means adapted to grip the candy and accompanying wrapping paper, a twister which twists open ends of the wrapping paper and a discharge means which ejects the twist-wrapped candy.

12 Claims, 19 Drawing Sheets

TWIST-WRAPPING MACHINE

BACKGROUND OF THE INVENTION

1. Field of the Invention

This invention relates to a twist-wrapping machine which takes out wrapping loads, such as candies, one after another, wraps them in wrapping paper individually and twists the free ends of the wrapping paper.

2. Description of the Related Art

As a twist-wrapping machine of this type, the present applicant already proposed an innovation in Japanese Patent Application Kokai S-60-13610. This twist-wrapping machine, as shown in FIGS. 18 and 19, is a machine of the type that wrapping paper is supplied in a vertically downward direction and, in timed relation with the arrival of wrapping paper B in front of a candy A, a pusher arm 25A pushes the candy A in a horizontal direction. The machine is so designed that when the pusher arm 25A pushes the candy in a horizontal direction, fork fingers 57A and 58A of a fork hand 53A assume their "open" position in front of the candy [cf. FIG. 20(*a*)].

Since a push-back bar 34A preenergized to press the candy back is disposed in the center of fork fingers 57A, 58A, the candy and wrapping paper pushed out by pusher arm 25A as a unit are first held in position by the pusher arm 25A and push-back bar 34A. Then, as the fork fingers 55A, 58A are closed, the candy and paper are received by the fork hand 53A [cf. FIG. 20(*b*)–(*d*)].

However, this twist-wrapping machine has the drawback that because the candy is pushed out in a horizontal direction, it frequently happens, depending on the posture of the load, that the candy is not properly held in position by the pusher arm 25A and push-back bar 34A. Particularly when the profile of the candy is composed of curved lines, the area of contact between the candy and the pusher arm 25A and push-back bar 34A is comparatively small and, hence, the holding power, which is as much less, may result in dropping of the candy in high-speed operation.

Furthermore, since the candy pushed out is held in position by the backward pressure exerted by the push-back bar 34A, a variation in the shape and size of candy A results in changes in holding power and holding condition so that the load cannot be held in the optimal condition. Moreover, the path of movement of the push-back bar 34A is dependent on the configuration of a cam groove 51A and it is not easy to insure a complete agreement between the locus of the push-back bar 34A and that of the pusher arm 25A. For this reason, too, it was difficult to stabilize the holding condition of loads.

Under these circumstances, the conventional twist-wrapping machine cannot be operated at a sufficiently high load takeout speed and this speed is a rate-determining factor in the operating speed of the whole machine.

The object of this invention is to overcome the above-mentioned disadvantages and provide a twist-wrapping machine which is capable of providing a fast and stable load takeout action regardless of the shape of the wrapping load. In other words, the object of this invention is to provide a twist-wrapping machine capable of realizing an increased overall processing speed.

SUMMARY OF THE INVENTION

Designed to accomplish the above object, the twist-wrapping machine of this invention comprises an aligner for orienting a plurality of units of a wrapping load one by one, a takeout means for taking out the load from said aligner, a wrapping paper feeder for bringing a wrapping paper close to the load taken out by said takeout means, a fork means for gripping the load and accompanying wrapping paper in position, a twister for twisting the free ends of said wrapping paper accompanying the load as so held in position, and a discharge means for ejecting the wrapped load, said aligner including a rotary disk which is capable of intermittent rotation within a horizontal plane and has holding apertures for accommodating said units of the load, said takeout means including a pushup member adapted to move in a path of motion through said holding apertures, and a pusher arm adapted to press down the load set on said pushup member, said pushup member being structurally independent of said fork means, and said pusher arm being adapted to move in association with said pushup member to eject the load in an upward direction.

Since the takeout means of the machine of this invention takes out the load in an upward direction, the load can be transferred to the fork means at a faster speed and more positively than it is the case with the conventional machine so that the overall wrapping speed can be increased. Moreover, when the takeout means is provided with a pushup arm, a wrapping paper holding arm and a pusher arm, the takeout action becomes more positive and when the paths of movement of these members are constructed by crank mechanisms, the takeout and wrapping operation is rendered even more smooth and fast.

DETAILED DESCRIPTION OF THE PREFERRED EMBODIMENT

The twist-wrapping machine as one embodiment of this invention is now described, reference being had to FIGS. 1 through 17.

Figure 1:
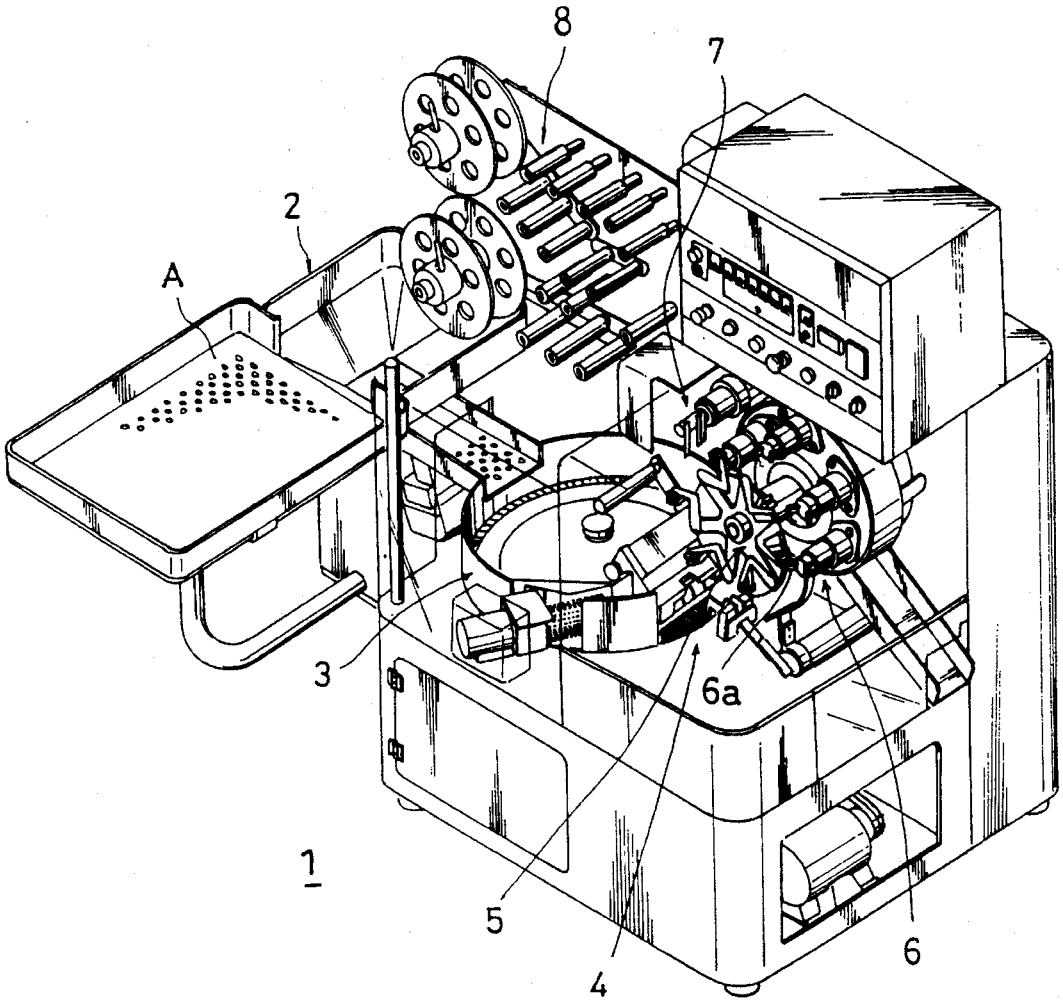
FIG. 1 is a schematic view showing the twist-wrapping machine as a preferred embodiment of the invention.

As shown in FIG. 1, this twist-wrapping machine 1 comprises a hopper 2 which outputs a plurality of candies A, an aligner 3 which lines up said plurality of candies in an independent discrete fashion, a takeout means 4 which takes out the candies so aligned in the upward direction, a fork means 5 which grips the candy together with wrapping paper, a twister 6 which twists free ends of the wrapping paper surrounding the candy, and a discharge means 7 which discharges the twist-wrapping candy, and a paper feeder 8 which pays out the wrapping paper in timed relation with the actions of the aligner 3 and discharge means 4.

Figure 2:
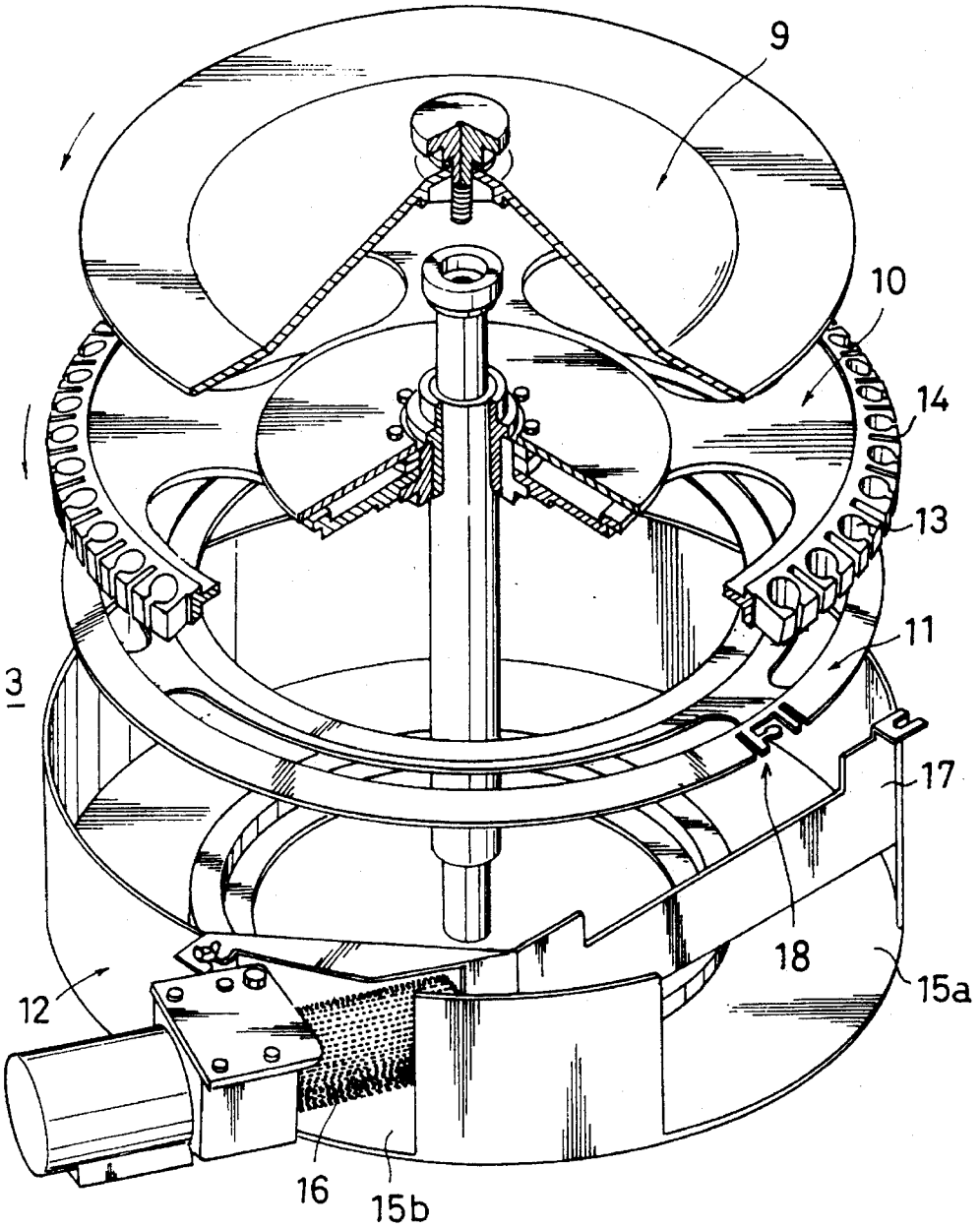
FIG. 2 is a detailed view of a segment of the aligner.

The aligner 3, as shown in FIG. 2, comprises a parasol-shaped disk 9 inclined toward its periphery, an aligning disk 10 disposed in registry with said parasol-shaped disk 9, an annular plate 11 disposed adjacent the underside of said aligner disk 10, and a frame 12 configured in the shape of a bottomed cylinder, said parasol-shaped disk 9, aligning disk 10 and annular plate 11 being housed in said frame 12. While the annular plate 11 is rigidly secured to the frame 12, the aligning disk 10 is free to revolve intermittently within a horizontal plane when driven by a driving means not shown. The parasol-shaped disk 9 is designed to revolve continuously at a speed higher than the speed of said aligning disk 10.

Figure 3:
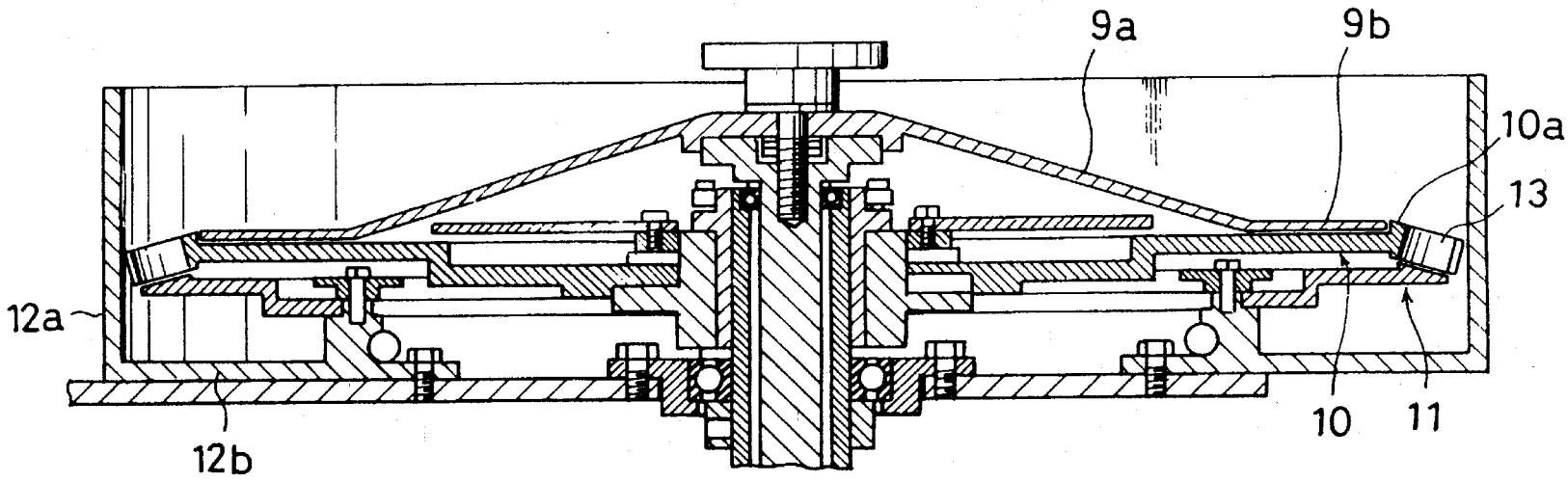
FIG. 3 is a sectional view showing a segment of the aligner.

The parasol-shaped disk 9, as shown in FIG. 3, comprises a downwardly tilted central part 9*a* and a horizontal peripheral part 9*b* and the candy outputted from the hopper 2 drops on the central part 9*a*. The aligning disk 10 has a downwardly inclined peripheral part 10*a* which is formed with holding apertures 13 and cutout grooves 14 arranged at regular intervals. The shape and size of said holding apertures 13 are complementary and commensurate with those of the candy and are of course altered according to the kind of wrapping load.

In operation, the parasol-shaped disk 9 revolves continuously and the aligning disk 10 revolves intermittently at a lower speed relative to the parasol-shaped disk 9 so that the candy falling on the central part 9*a* of the parasol-shaped disk 9 is transferred through the peripheral part 9*b* of the parasol-shaped disk 9 into a holding aperture 13 of the aligning disk 10. On the other hand, because the annular plate 11 is disposed stationarily under the aligning disk 10, the candy accommodated in said holding aperture tambles on the annular plate 11 as the result of intermittent rotation of the aligning disk 10 and assumes a predetermined posture. Since the parasol-shaped disk 9 is revolving continuously at a high speed relative to the aligning disk 10, the next candy is promptly accommodated in the holding aperture 13 after the preceding candy has been removed from the same aperture 13.

The frame 12 consists of a cylindrical part 12*a* and a bottom part 12*b* and the cylindrical part 12*a* is formed with a first and a second opening 15*a*, 15*b*. The first opening 15*a* provides an operating space for the discharge means 4 in removal of the candy from the holding aperture 13. Thus, the candies aligned by the holding aperture means 13 are removed one after another by the discharge means 4 operating in the above position of first opening 15*a*.

Disposed in the second opening 15*b* is a rotary brush 16, and a candy guide 17 is disposed in proximity with said rotary brush 16. This rotary brush 16 assists in the aligning of the candy by its revolution. Thus, by brushing the candy accommodated in the holding aperture 13, the rotary brush 16 orients the candy, even one in an upright position, into an oriented position and pushes back the candy not accommodated in the holding orifice 13. The candy guide 17 is provided for preventing the candy from dropping out from the first opening 15*a*.

Figure 4:
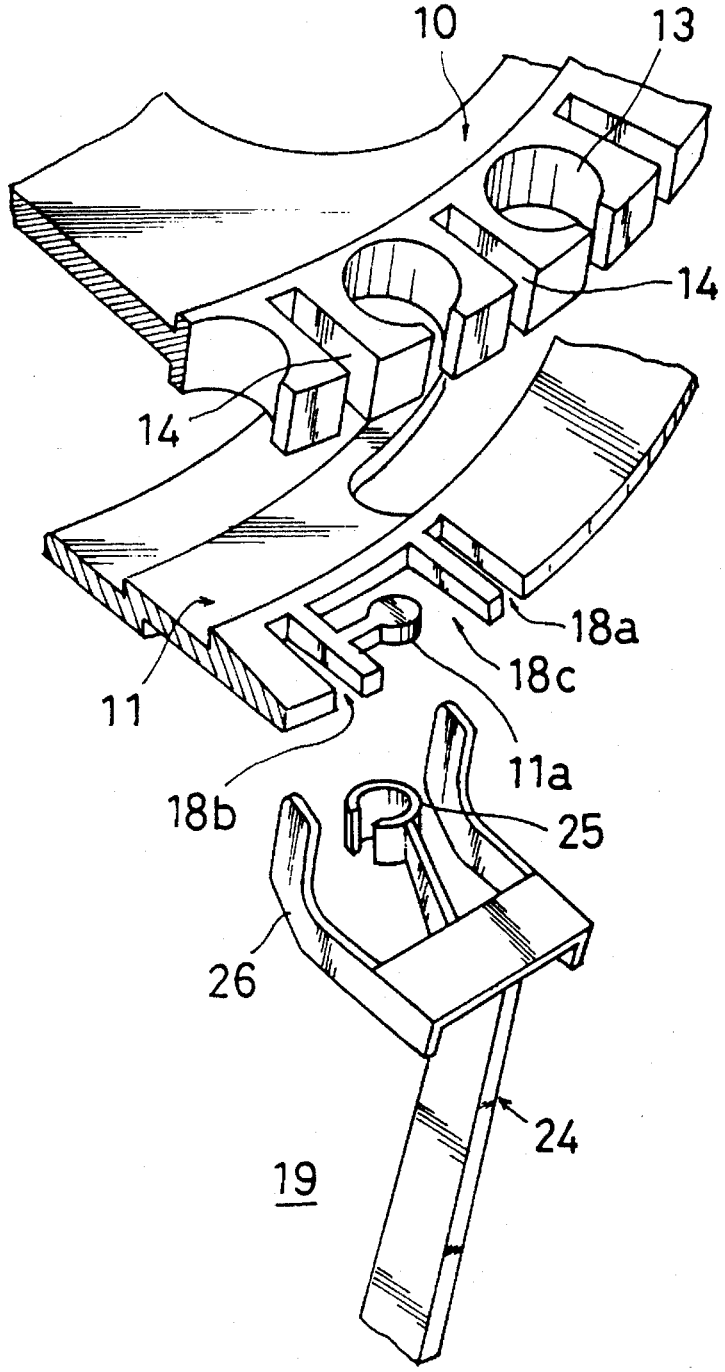
FIG. 4 is a diagrammatic view illustrating the relationship of the aligner rotary disk and annular plate and the load (candy) pushup member.

The annular plate 11 is formed with a cutout portion 18 in the position corresponding to the first opening 15*a*. As shown in FIG. 4, this cutout portion 18 comprises a pair of slits 18*a*, 18*b* and a cut-off portion 18*c* disposed between said slits 18*a*, 18*b*, and these slits 18*a*, 18*b* have the same spacing and are of the same width as slits 14 formed in the aligning disk 10. It is also so arranged that, with the annular plate 11 being secured to the bottom part 12*b* of the frame 12, the slits 18*a*, 18*b* are in alignment with the slits 14, 14. Moreover, disposed in the cutoff portion 18*c* is a holder 11*a* for preventing the candy in the holding orifice means 13 from dropping.

Figure 5:
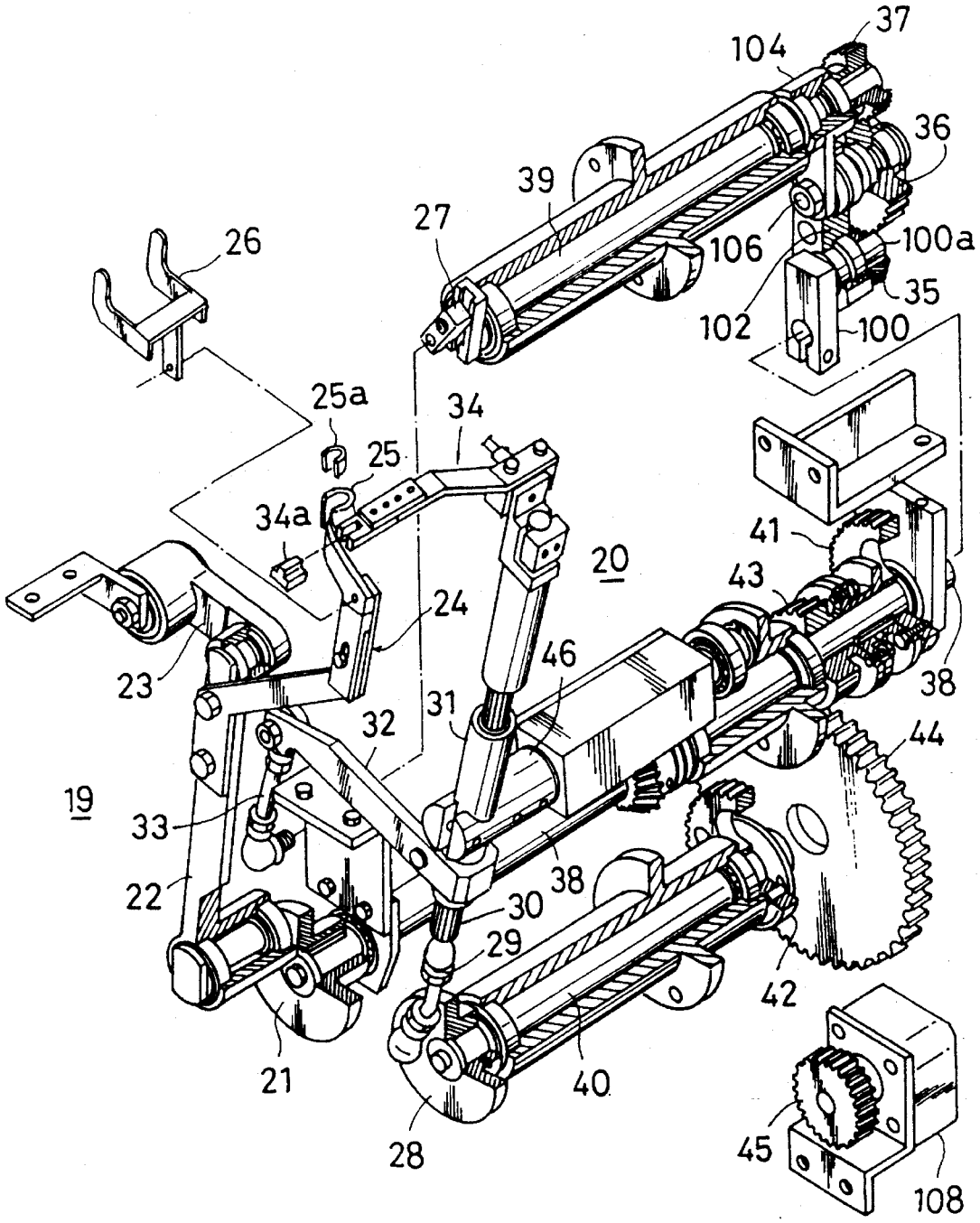
FIG. 5 is a diagrammatic view showing the internal construction of the takeout means.
Figure 6:
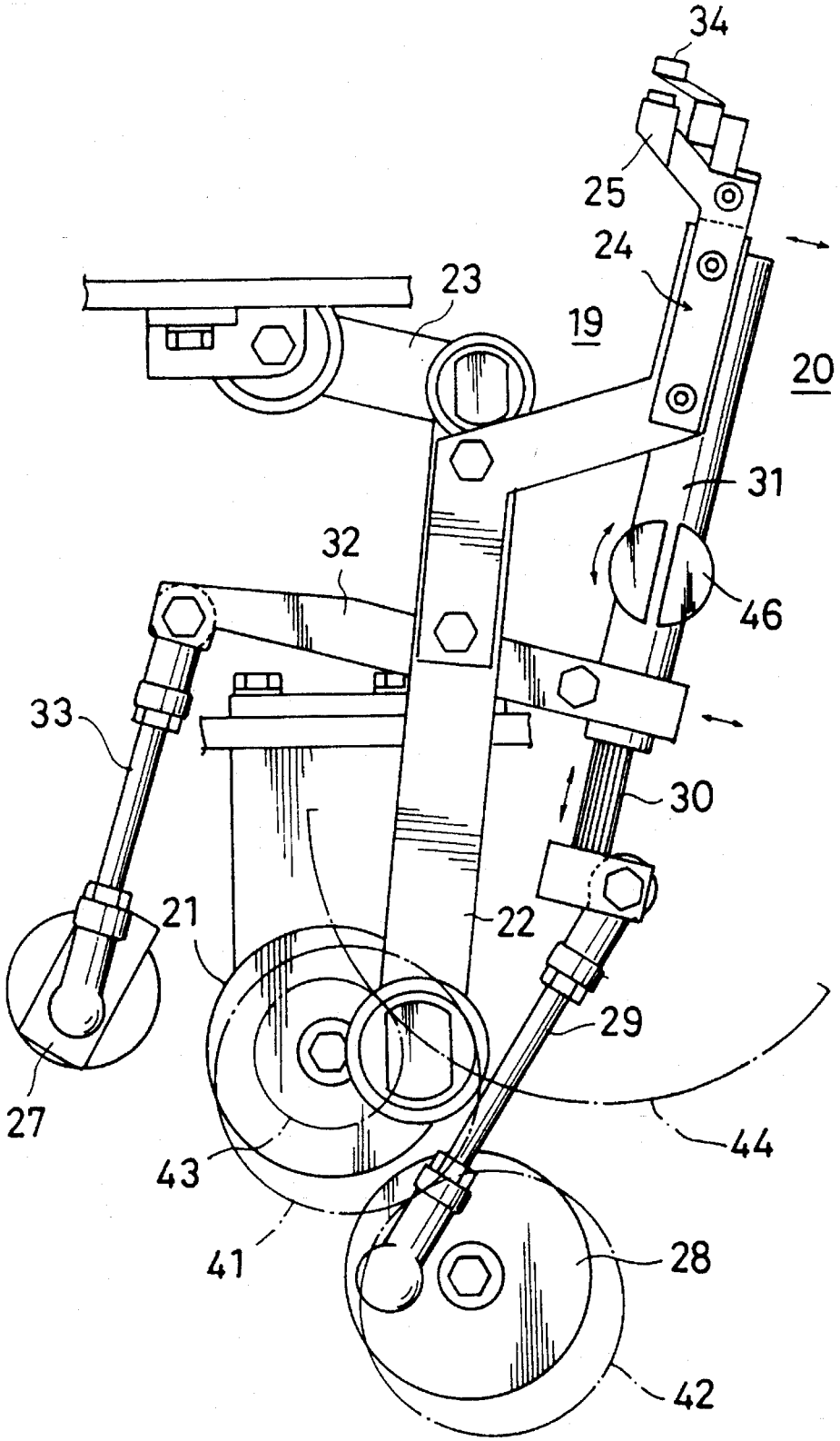
FIG. 6 is a schematic view showing the cardinal part of the takeout means.

The discharge means 4, shown in FIGS. 5 and 6, comprises a pushup mechanism 19 for pushing out the candy in the holding aperture 13 and a pressor mechanism 20 for pressing down the pushed-up candy accompanied by the wrapping paper.

The pushup mechanism 19 comprises a first crank 21, a first rod 22 connected to the first crank 21 through a pin, a swing lever 23 which is swingably connected to the other end of the first rod 22 through a pin, and a candy pushup member 24 rigidly secured to the first rod 22. This candy pushup member 24 is provided with a pushup arm 25 which supports the candy from below and pushes it up and a paper holding arm 26 for holding the wrapping paper supplied from a wrapping paper feeder 8, and pushup arm 25 is fitted with a rubber member 25*a*. The pushup arm 25 and wrapping paper holding arm 26 pass through the cutoff portion 18 of the annular plate 11, the slits 14 and holding apertures 13 of the aligning disk 10 in the upward direction (cf. FIGS. 4 and 7).

The pressor mechanism 20 comprises a second crank 27 which is driven by meshing of gears 35, 36 and 37, a third crank 28 which is driven at a variable speed by meshing of elliptical gears 41, 42, a third rod 29 connected to said third crank 28 through a pin, a splined shaft 30 connected to said third rod 29, a case 31 housing said splined shaft 30, a lever 32 rigidly secured to said case 31 and a second rod 33 connected to said lever 32 and second crank 27. The splined shaft 30 is fitted with a pressor arm 34 and the forward end of this pressor arm 34 is fitted with a rubber member 34*a*. This pressor arm 34 is designed to retain from above the candy pushed up by the pushup arm 25.

The pushup mechanism 19 and pressor mechanism 20 are driven by intermeshing of gears 44 and 43 and the motions of the respective mechanisms 19, 20 are synchronized with the rotary motions of the twister 6 and fork means 5. The mechanisms for power transmission by means of gears and the like are now described.

The rotary shaft 38, which is driven by the intermeshing of gears 44, 43, is provided with a crank 100 rigidly secured thereto, and a crank 100 has a projecting shaft 100*a* which is offset from the rotary shaft 38. Keyed to this projecting shaft 100*a* is a gear 35 which is in mesh with a gear 36 which, in turn, is rotatably connected to a shaft 106 through a bearing. The gear 36 is also in mesh with a gear 37 which, in turn, is keyed to a rotary shaft 39 of a second crank 27. The projecting shaft 100*a* and shaft 106 are rotatably interconnected by a rod 102 through respective bearings. A lever 104 secured to a shaft 106 is also rotatably connected to a rotary shaft 39 through a bearing.

The rotary shaft 39 of the second crank 27 is driven through the above transmission mechanism. Therefore, as the rotary shaft 38 is driven by the intermeshing of gears 44, 43, the rotary shaft 39 swings in response to the revolution of the rotary shaft 38. On the other hand, an elliptical gear 42 of the rotary shaft 40 is in mesh with an elliptical gear 41 of the rotary shaft 38 so that whereas the rotary shaft 38 revolves at a constant speed, a rotary shaft 40 of the second crank 28 revolves at a variable speed. A gear 45 is in mesh with the gear 44 and an encoder 108 detects the rotational speed of the rotary shaft 38 of said first crank 21.

The paths of movement of the thus-constructed pushup mechanism 19 and pressor mechanism 20 are now described.

Figure 7:
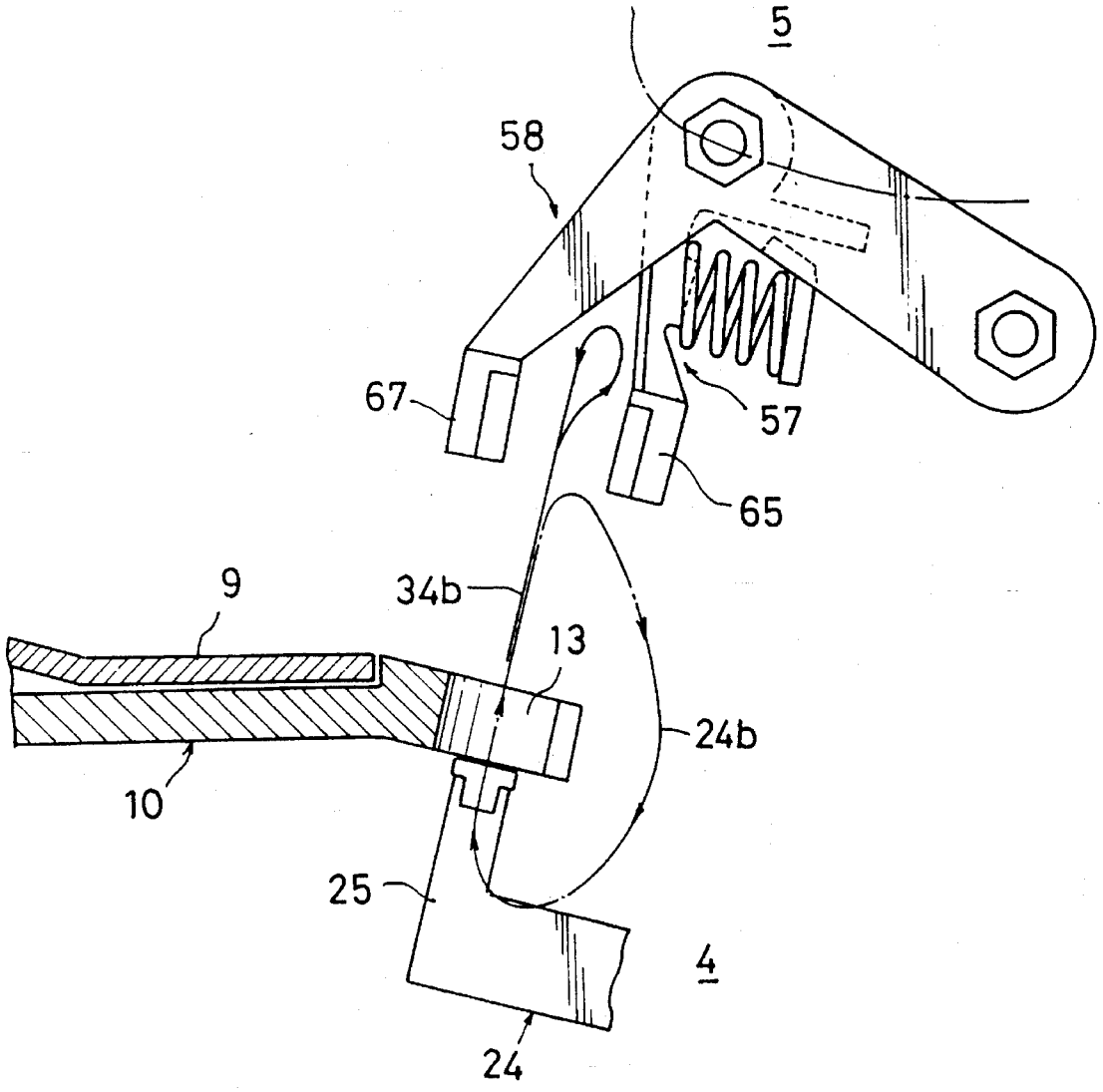
FIG. 7 is a diagrammatic representation of the paths of movement of the pushup member and pusher arm.

While the rotary shaft 38 driving the pushup mechanism 19 revolves in correspondence with the rotational speed of the aligning disk 10 etc. of the aligner 3 and this revolving motion is transmitted to the swing lever 23 by the first crank 21 and first rod 22 to thereby cause the swing lever 23 to swing. Since the candy pushup member 24 is rigidly secured to the first rod 22, the candy pushup member 24 traces an elliptical path of movement 24*b* reflecting the movement of the first crank 21 and swing lever 23 (FIG. 7). Thus, the candy pushup member 24 comprising the pushup arm 25 and paper holding arm 26 ascends linearly through the holding aperture 13 of the aligning disk 10 and descends apart from the aligning disk 10.

On the other hand, the path of movement of the pressor mechanism 20 is drawn by the movements of said second crank 27 and third crank 28. More detailedly, since the third crank 28 is driven by the intermeshing of elliptical gears 41 and 42, the splined shaft 30 connected to the third crank 28 reciprocates in vertical directions. The pressor arm 34, which is rigidly secured to this splined shaft 30, also undergoes reciprocation in a similar fashion but, in this particular machine, it is so designed that the descending speed is higher than the ascending speed and that the ascending speed of this pressor arm 34 is consonant with the ascending speed of said pushup arm 25.

The rotary shaft 39 of the second crank is caused to swing by the intermeshing of gears 35, 36 and 37 and, in correspondence with this swinging motion, the lever 32 and cylinder 31 swing about a pivotal shaft 46. As the cylinder 31 swings, the splined shaft 30 accommodated in the cylinder 31 also revolves so that the pressor arm 34 secured rigidly to the splined shaft 30 is rotated in association. Since, as mentioned above, this pressor arm 34 is caused by the third crank 28 to reciprocate up and down, the pressor arm 34 traces the path of movement 34*b* depicted in FIG. 7, as the result of combination of the above reciprocating motion and the rocking motion due to the second crank. Thus, the pressor arm 34 first ascends linearly, then ascends further but is displaced to the right-hand side, thereafter returns to the left-hand side, and finally descends linearly. It is also insured that the ascending motion and subsequent displacement to the right-hand side are in complete agreement with the movement of the pushup arm 25 in locus and speed.

Figure 8:
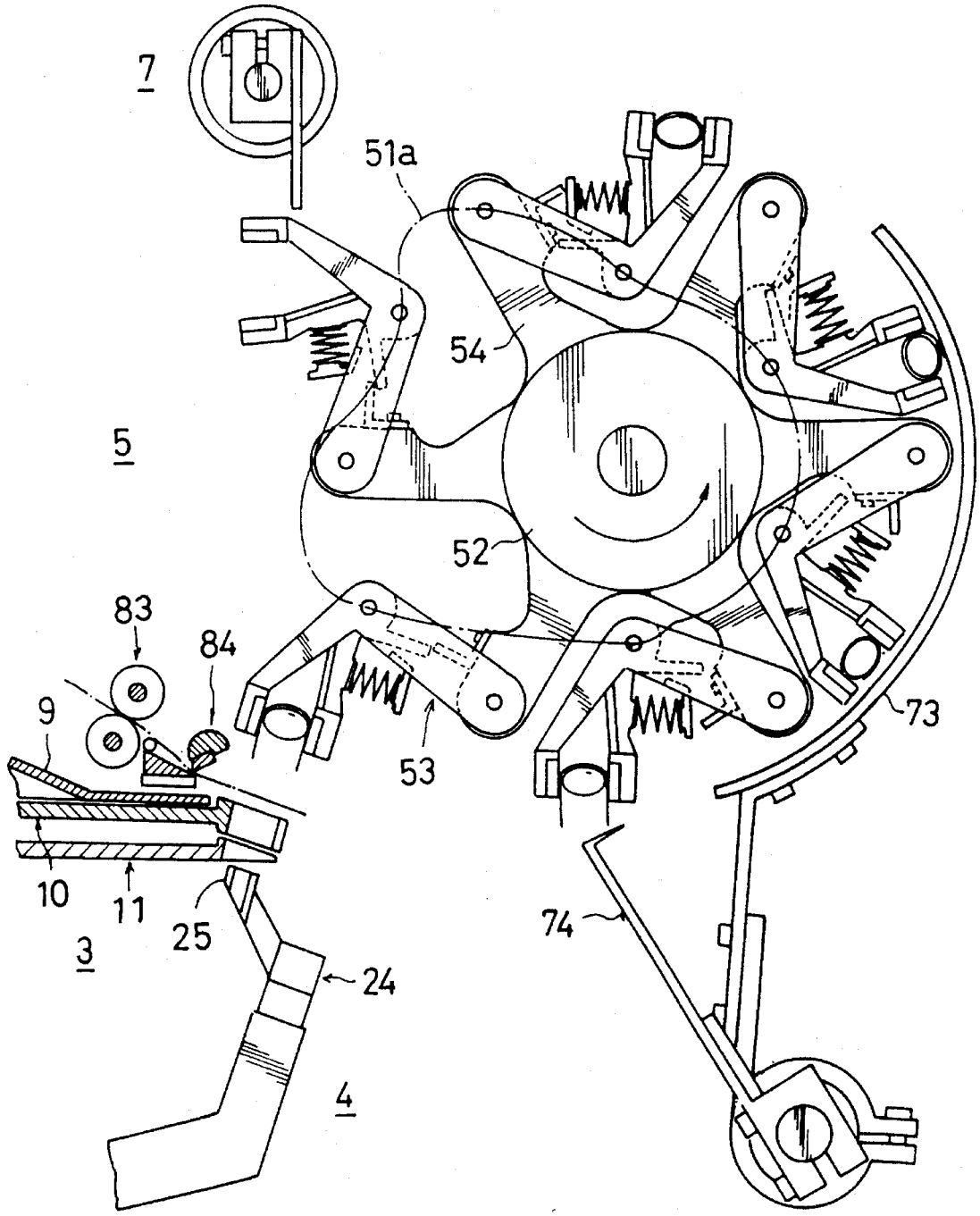
FIG. 8 is a diagrammatic view showing the geometrical relation of the aligner, takeout means, fork means and discharge means.

Disposed above the takeout means 4 which acts as described above are a fork means 5 and a discharge means 7 (FIGS. 7 and 8). The fork means 5 receives and holds in position the candy taken out by the takeout means 4 and wrapping paper and revolves counterclockwise in a vertical plane to transport them to the position of said discharge means 7.

Figure 9:
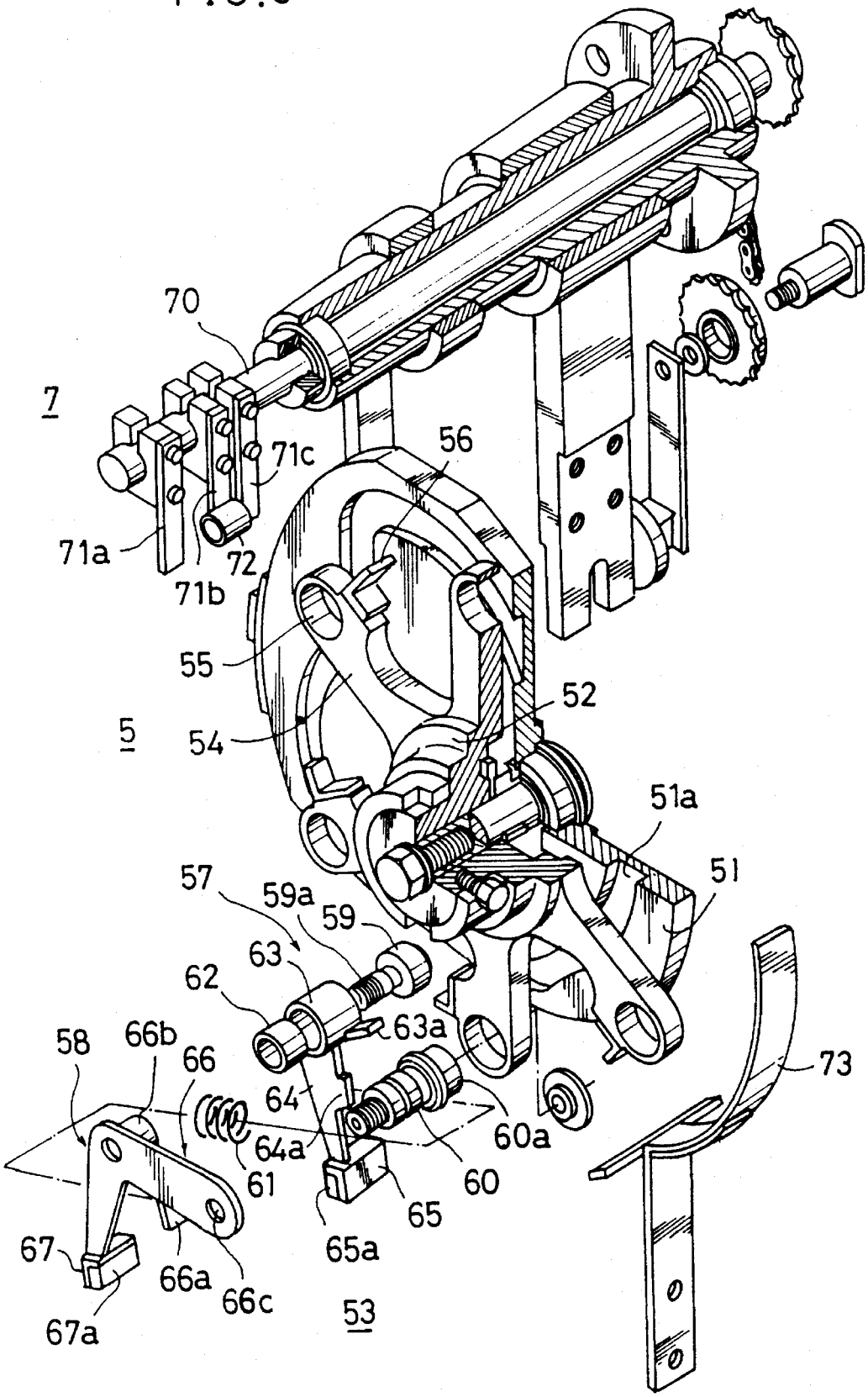
FIG. 9 is a diagrammatic view showing the internal construction of the fork means.

The fork means 5 comprises a cam plate 51 provided with a cam groove 51*a*, a rotary plate 52 which revolves in a vertical plane, and six fork hands 53 adapted to hold the wrapping paper B and candy A. The rotary plate 52 is radially formed with six rotary arms 54 and each rotary arm is provided with a cylindrical opening 55 and an L-shaped engaging member 56 at its forward end (FIG. 9).

Each of the fork hands 53 essentially comprises a first digit 57, a second digit 58, a cam follower 59, a connecting arm 60, a spring 61 and a bush 62. The first digit 57 comprises a cylindrical portion 63 equipped with an engaging member 63*a*, a connecting portion 64 equipped with a projection 64*a*, and a first fingertip portion 65 equipped with a rubber member 65*a*, and the second digit 58 comprises an L-shaped body portion 66 equipped with a spring seat 66*a*, a cylindrical portion 66*b* and a through hole 66*c* and a second fingertip portion 67 equipped with a rubber member 67*a*.

Figure 10A:
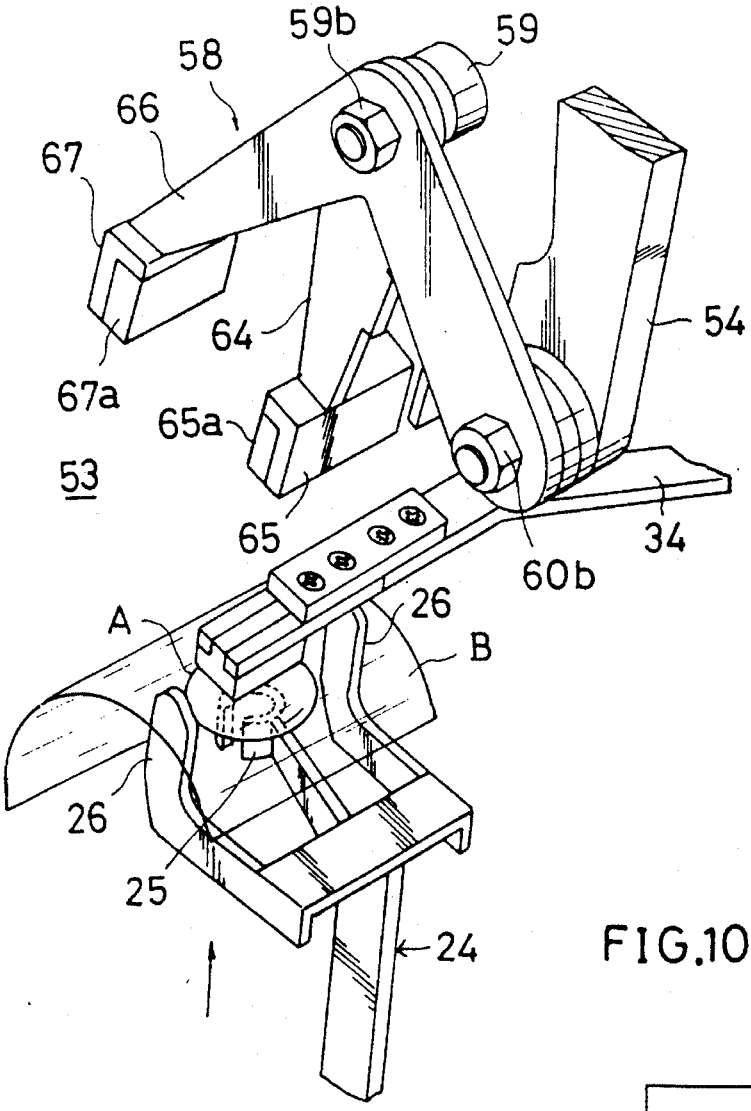
FIGS. 10(*a*)–10(*c*) is a diagrammatic view showing the relationship of the fork hand, pushup member and pusher arm.
Figure 10B:
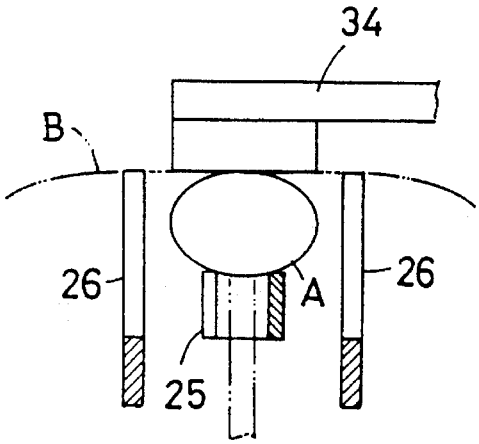
Figure 10C:
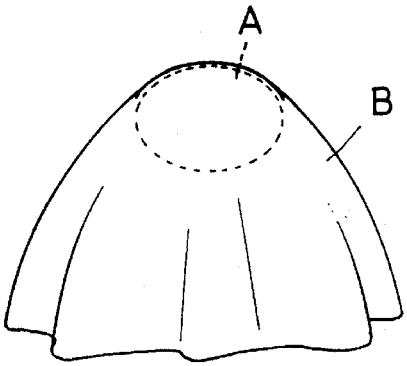

The cylindrical portion 66*b* of the second digit 58, the bush 62 and the cylindrical portion 63 of the first digit 57 are assembled as the unit, with an axial shaft 59*a* of the cam follower 59 being passed therethrough and locked with a nut 59*b* (FIG. 10). In this state, the engaging member 63*a* of the first digit 57 faces the engaging member 56 of the rotary arm 54 and a spring 61 loaded between the projection 64*a* of the first digit 57 and the spring seat 66*a* of the second digit 58 biases the first digit 57 and second digit 58 in their closing directions. The through-hole 66*c* of the second digit 58 and the connecting arm 60 are rigidly secured with a nut 60*b* (FIG. 10) and one end 60*a* of the connecting arm 60 is rotatably connected to the cylindrical opening 55 of the rotary arm 54.

On the other hand, the cam follower 59 is inserted into the cam groove 51*a* so that the cam follower 59 may travel along the cam groove 51*a* in response to the rotation of the rotary arm 54. As the cam follower 59 travels, the angle θ of intersection (FIG. 11) of the body portion 66 of the second digit 58 with the rotary arm 54 is altered so that the topological relation between the engaging member 63*a* of the first digit 57 and the engaging member 56 of the rotary arm 54 is changed. Thus, when the cam follower 59 has moved counterclockwise into a position between P1 and P2 of the cam groove 51*a*, the engaging member 63*a* and engaging member 56 are not engaged with each other so that the fork hand 53 may close to grip the candy A and wrapping paper B. On the other hand, when the cam follower 59 has moved to the position P2, the engaging member 56 of the rotary arm 54 is brought into engagement with the engaging member 63*a* of the first digit 57 so that the fork hand 53 opens (FIG. 12). The open fork hand 53 continues to move counterclockwise in that condition but when the cam follower 59 passes the position P1, it closes for gripping.

Figure 11:
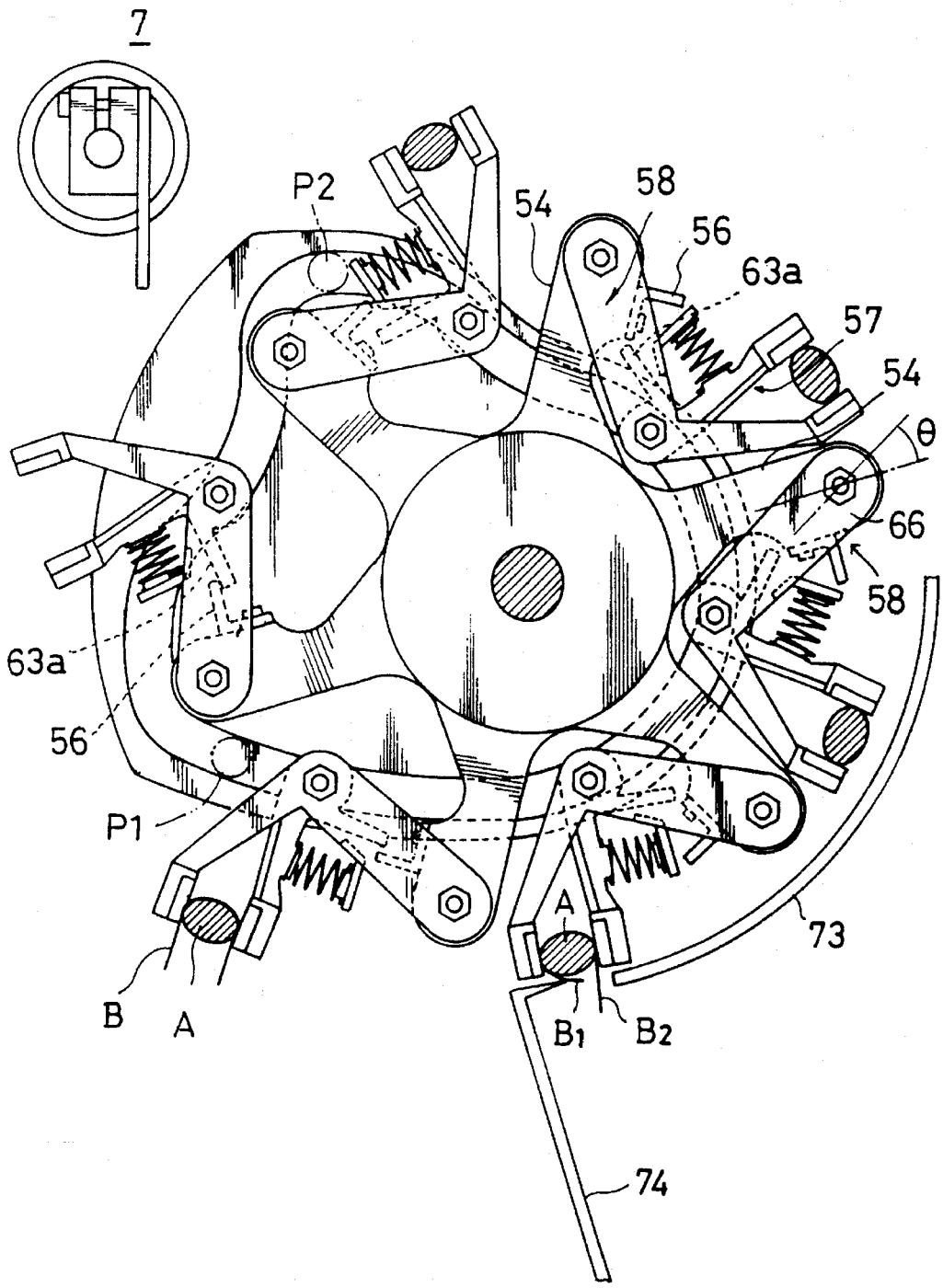
FIG. 11 is a diagrammatic view showing the fork hand in its open position.
Figure 12A:
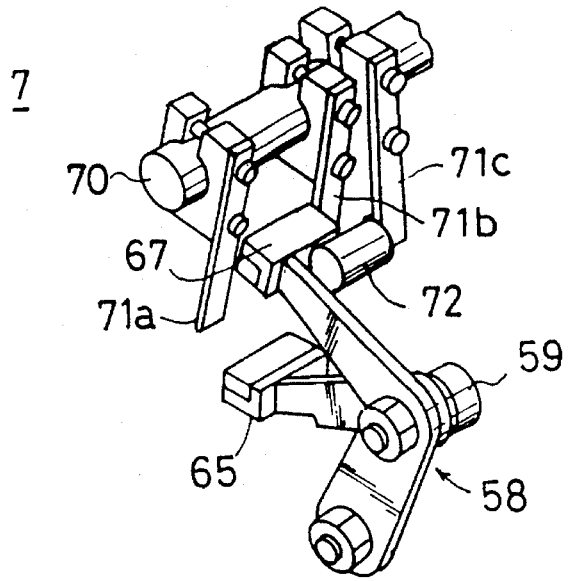
FIGS. 12(*a*)–12(*c*) is a diagrammatic view showing the relationship of the discharge means and fork hand.
Figure 12B:
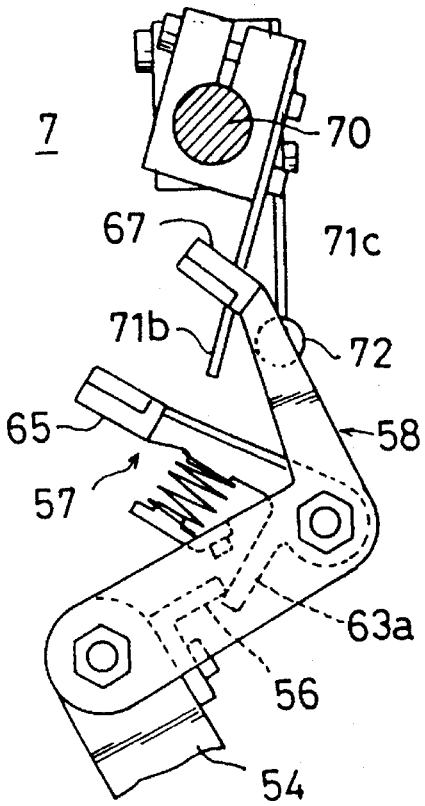
Figure 12C:
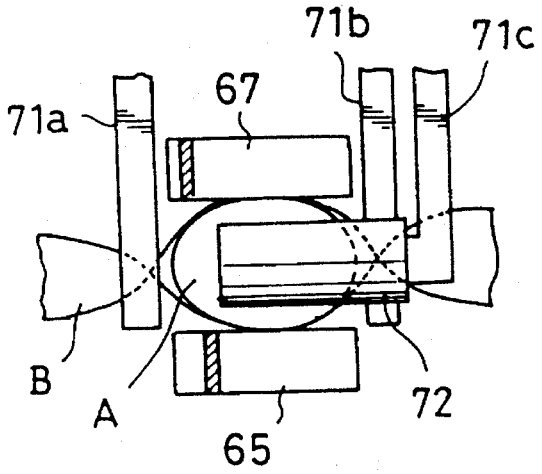
Figure 13A:
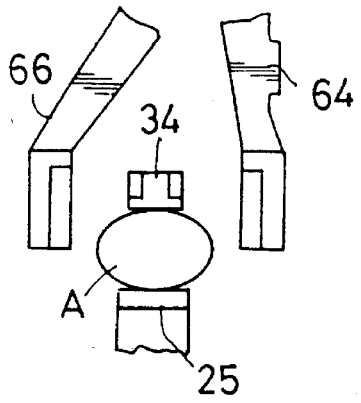
FIGS. 13(*a*)–13(*e*) is a diagram explaining the actions of the pushup member and pusher arm.
Figure 13B:
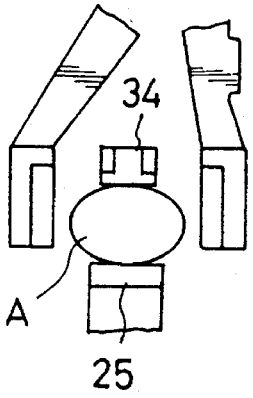
Figure 13C:
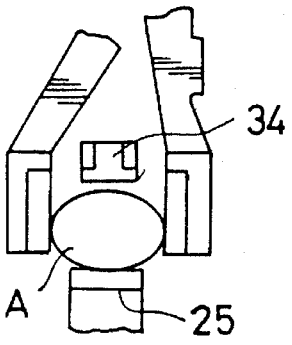
Figure 13D:
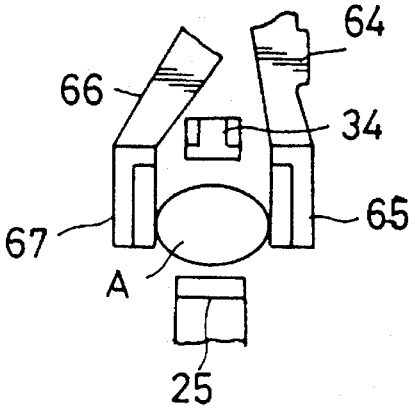
Figure 13E:
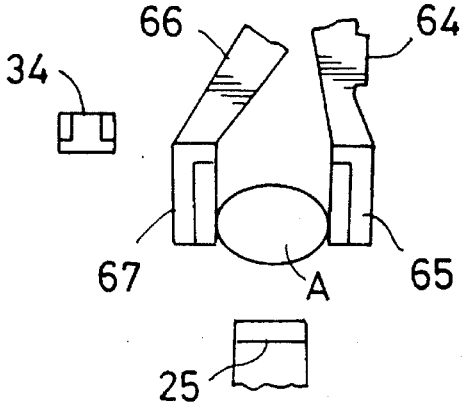

As shown in FIGS. 8 and 11, the fork means 5 is provided with a guide plate 73 adapted to fold back the wrapping paper B accompanying the candy A and a swing lever 74 adapted to swing to push in the wrapping paper B. While the candy A and wrapping paper B, held in position by the fork hand 53, are transferred as a unit towards the guide plate 73, the swing lever 74 pushes the left side B1 of the wrapping paper in the first place and, then in response to a further movement of the fork hand 53, the guide plate 73 folds back the right-hand side B2 of the wrapping paper (FIG. 11).

As illustrated in FIG. 1, the twister 6 is a per se known device which twists wrapping paper B at both free ends thereof while B is gripped by the fork hand 53 and has six pairs of spinning twister hands 6*a* in positions corresponding to the positions of fork hands 53. In FIG. 1, only one side of the twister 6 is shown for the convenience of drafting.

As shown in FIG. 9, the discharge means 7 comprises a rotary shaft 70 and discharge pawls 71*a*, 71*b*, and 71*c* as mounted on the rotary shaft 70, and the discharge pawl 71*c* is fitted with a rubber member 72. The rotary shaft 70 revolves through 2 turns while the fork hand 53 moves through 60 degrees (i.e. ⅙ circumference) and the discharge pawl 71*c* is adapted to turn at a predetermined interval from the discharge pawls 71*a* and 71*b*. Therefore, in timed relation with the ejection of both ends of wrapping paper B by the discharge pawls 71*a* and 71*b*, the rubber member 72 of the discharge pawl 71*c* pushes the candy A.

FIG. 12 shows the condition in which the cam follower has reached the position P2 of the cam groove 51*a* to open the fork hand 53 and the discharge pawls 71 are flipping out the candy A. As can be seen from FIG. 12, the three discharge pawls 71*a*, 71*b* and 71*c* act in association so that regardless of the softness (low rigidity) of wrapping B and the weight of the load, the candy A can be flipped off to a desired location with certainty.

Figure 14:
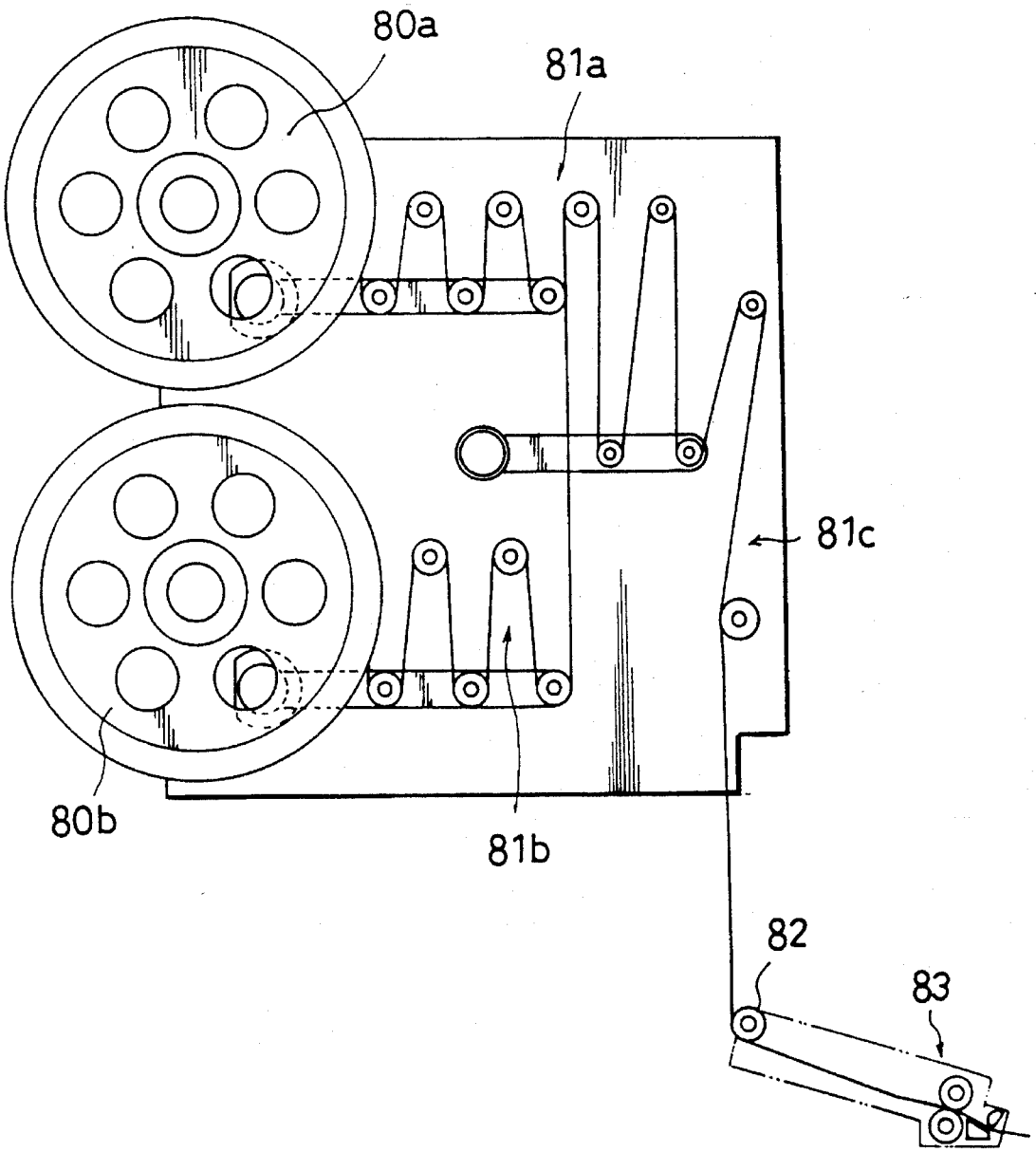
FIG. 14 is a view showing a portion of the wrapping paper feeder.
Figure 15:
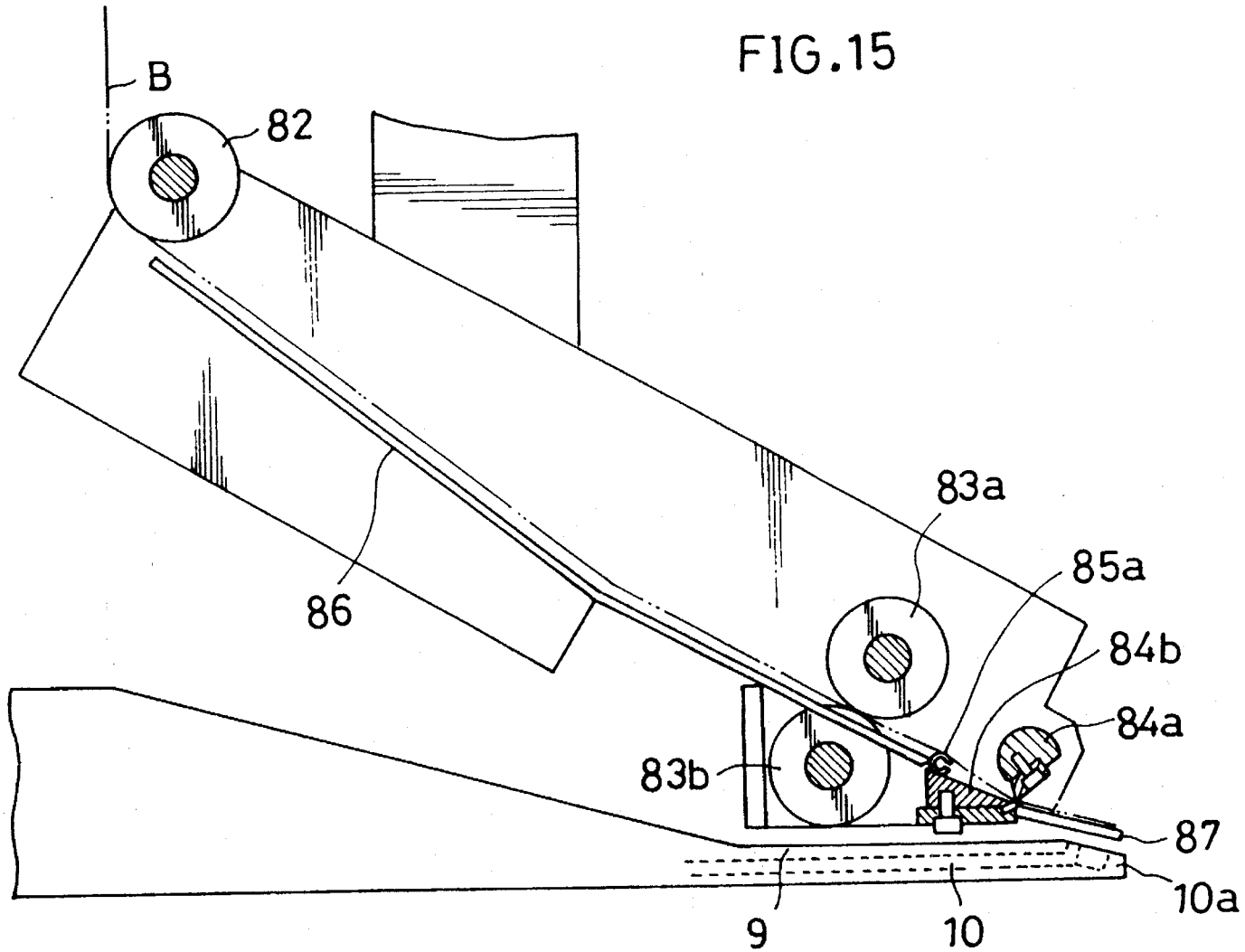
FIG. 15 is a diagrammatic view showing the topological relationship of the paper feeder and aligner.
Figure 16:
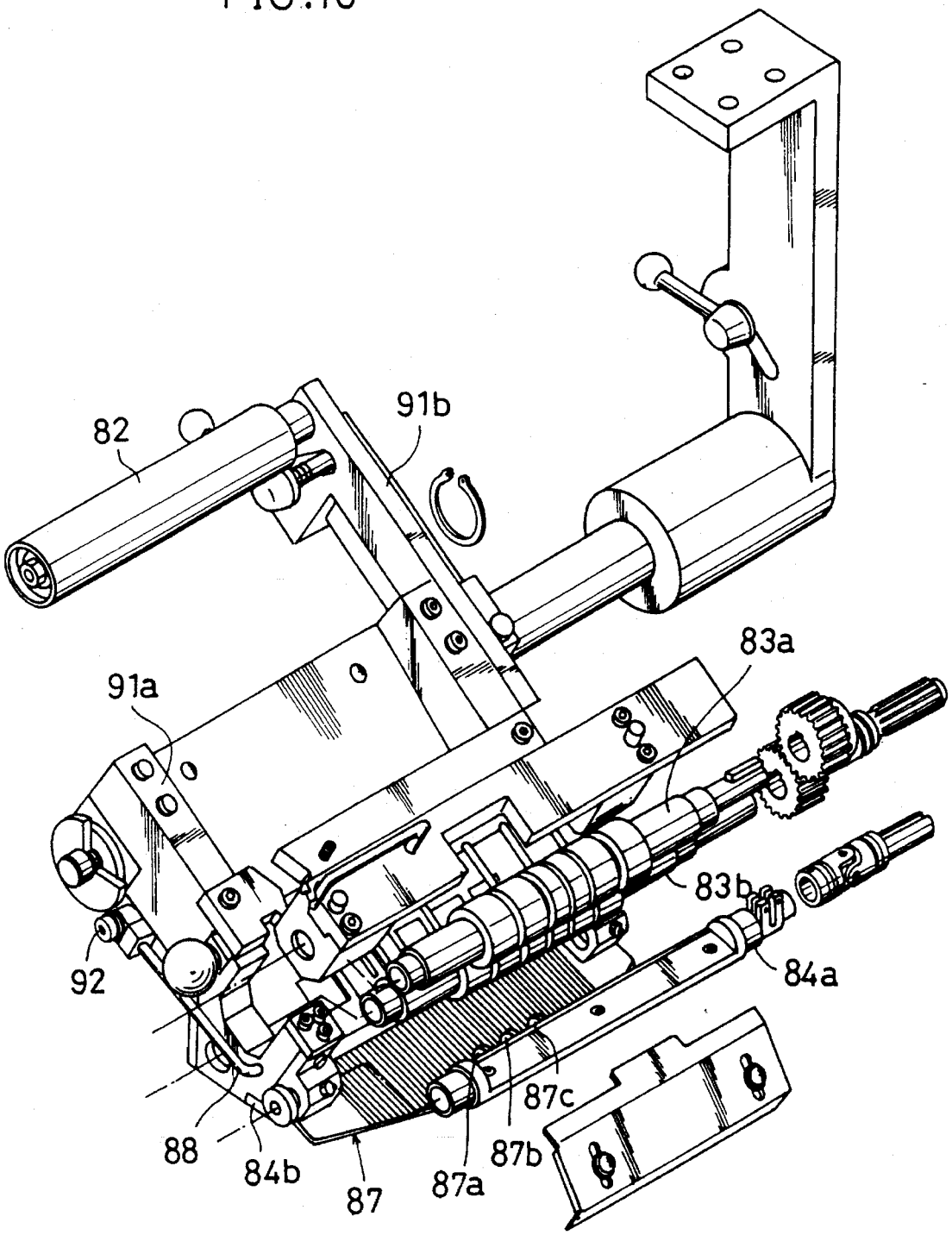
FIG. 16 is a perspective view showing a portion of the paper feeder.

As shown in FIGS. 14–16, the paper feeder 8 comprises a first and a second wrapping paper holder 80*a*, 80*b*, a first and a second roller set 81*a*, 81*b*, a third roller set 81*c*, a tension roller 82 for changing the direction of feed of the wrapping paper descending vertically, drive rollers 83*a*, 83*b* for paying out the wrapping paper, a rotary cutter 84 comprising a rotary blade 84*a* and a stationary blade 84*b* for cutting wrapping paper B at a predetermined timing, and an air jet means 85 which blasts jets of air through air nozzles 85*a*.

One of the wrapping paper holders 80*a*, 80*b* is a spare holder substituting the other wrapping holder and the wrapping paper B paid out from the roller set 81 is guided by guide plates 86, 87 to the position of a peripheral part 10*a* of an aligning disk 10. As shown in FIGS. 8 and 15, the drive roller 83 and rotary cutter 84 are disposed close to and above the peripheral part 9*a* of the parasol-shaped disk 9 and the wrapping paper B is supplied to a position over the candy A at the same angle of inclination as the peripheral part 10*a* of the aligning disk 10. The rotary cutter 84 cuts the wrapping paper B to a predetermined length in timed relation with the raising of wrapping paper B by a wrapping paper holder arm 26. The guide plate 87 is formed with notches 87*a*, 87*b* and 87*c* for allowing the passage of wrapping paper holder arm 26 and pushup arm 25 (FIG. 16).

Figure 17:
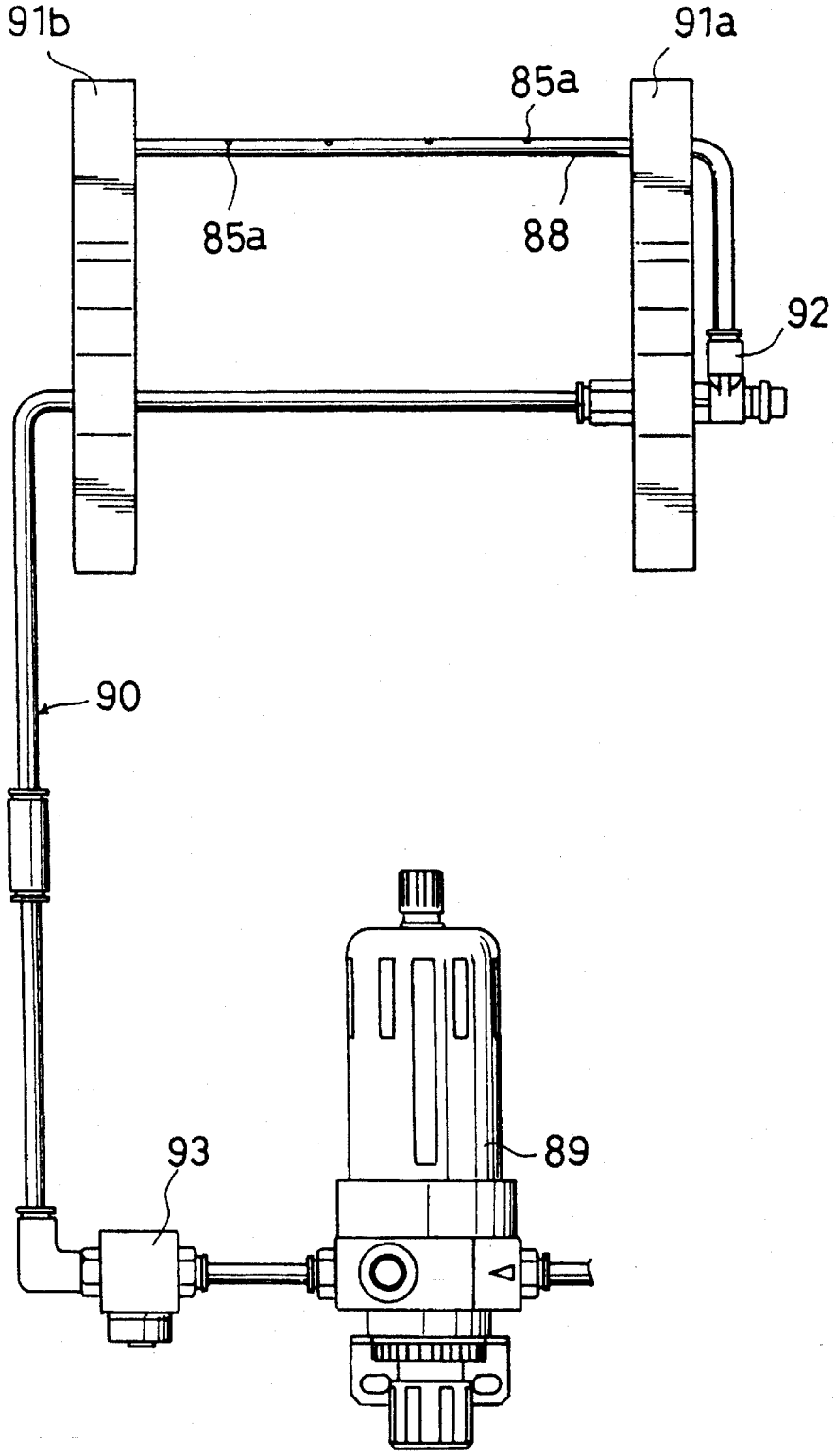
FIG. 17 is a schematic view illustrating an air jet means constituting a part of the paper feeder.
Figure 18:
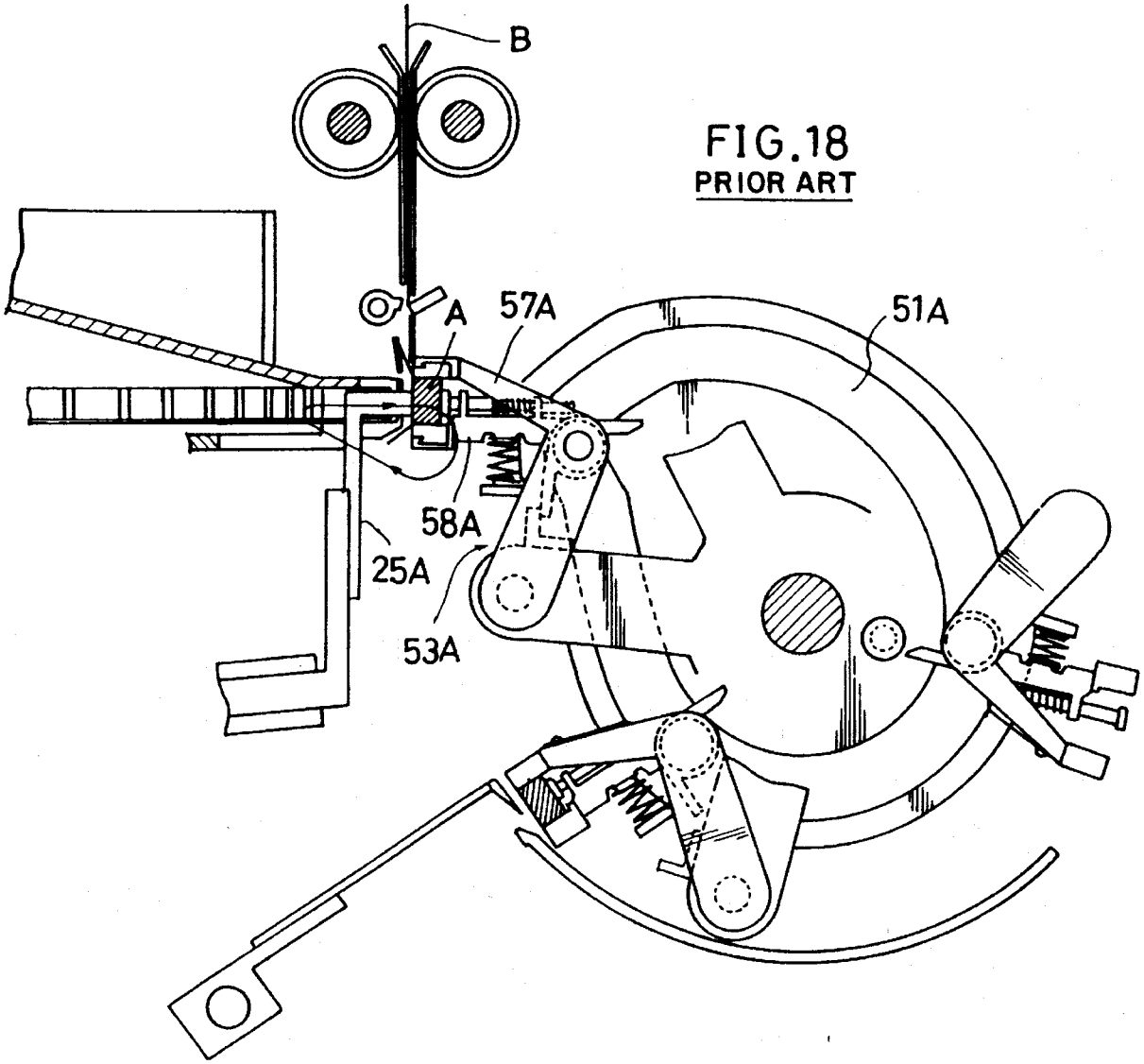
FIG. 18 PRIOR ART
FIG. 18 is a view showing the principal part of the conventional twist-wrapping machine.
Figure 19:
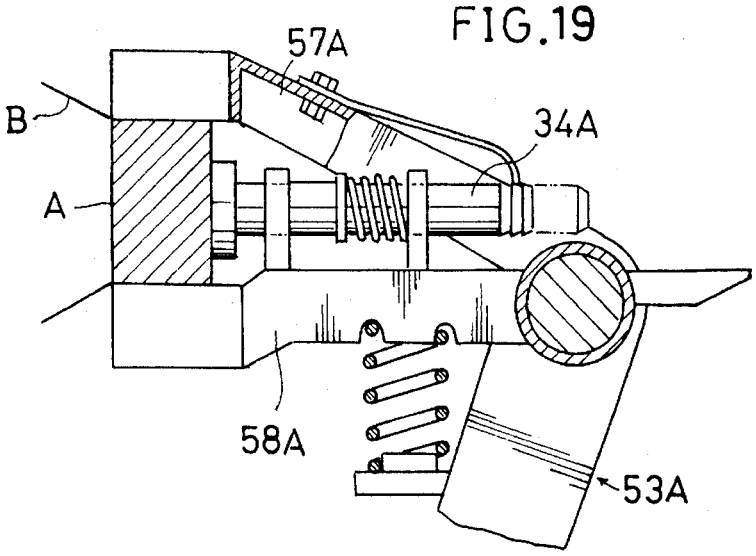
FIG. 19 is a view showing the conventional fork hand.
Figure 20A:
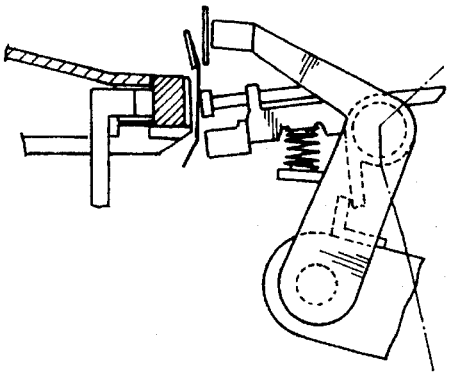
FIGS. 20(*a*)–20(*d*) is a view explaining the actions of the conventional twist-wrapping machine.
Figure 20B:
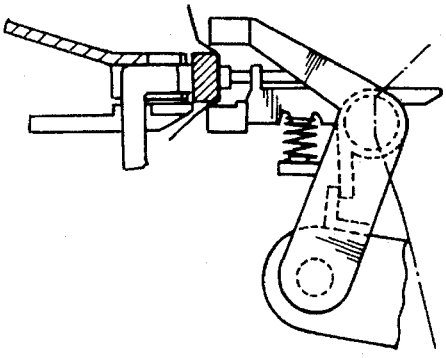
Figure 20C:
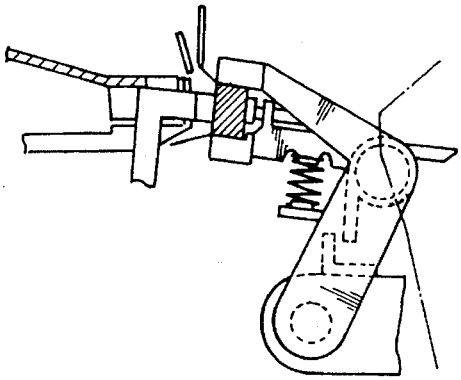
Figure 20D:
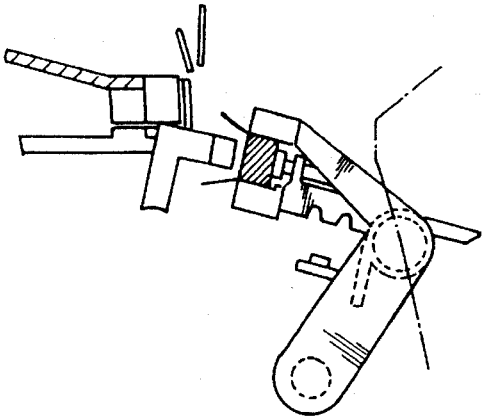

The air jet means 85 comprises, as shown in FIG. 17, an output pipe 88 equipped with a plurality of air jet nozzles or orifices 85*a*, a compressor (not shown), air filter 89 and a flow passageway 90 and the output pipe 88 is disposed between supporting frames 91*a*, 91*b*, with one end thereof being blinded. Ejected from said plurality of air jet orifices 85*a* are jets of air at a preset pressure so as to assist in the travel of wrapping paper B. The flow passageway 90 is provided with a controller 92 for regulating the amount of air to be delivered and a solenoid valve 93 for opening and closing the passageway 90.

The operation of wrapping candy A by means of the twist-wrapping machine 1 described above is now explained in further detail.

In the first place, the candy A is fed out from the hopper 2 onto the top surface of the parasol-shaped disk 9 of the aligner 3. In this stage, some units of load A may be resting on others but as the candies are driven towards the peripheral part 9*a* of the parasol-shaped disk 9 by the centrifugal force of the disk 9 revolving continuously, they are segregated one from another and accommodated individually in the holding apertures 13 of the aligning disk 10. The candies thus accommodated in the holding apertures 13 are caused to travel on the anular plate 11 in response to the intermittent rotation of the aligning disk 10. Therefore, by the rolling or tumbling motion they undergo in the course of their travel, the candies are oriented into a given posture. The rotary brush 16 assists in this orienting operation due to its own rotation.

Then, in response to the rotation of the aligning disk 10, the candies in the holding apertures 13 successively reach the position of the first opening 15*a* of the frame 12. As mentioned hereinbefore, this first opening 15*a* is located where each of the pushup arm 25 and pressor arm 34 moves in the path of a loop and where the fork hand 53*a* in open condition descends in an arcuate path. Therefore, the candy which has reached the position of first opening 15*a* is lifted by the ascending motion of the pushup arm 25 while the intermittently driven aligning disk 10 stands still for a time. Meanwhile, the guide plate 87 of the paper feeder 8 has been supplied with wrapping paper B by the drive roller 83 and, therefore, in timed relation with the lifting of the candy by the pushup arm 25, the rotary cutter 84 cuts the wrapping paper B and the wrapping paper holder arm 26 raises the wrapping paper B.

When the candy and wrapping paper are raised, the pressor arm 34 holds down the candy and wrapping paper in the bottom position of the path of motion shown in FIG. 7 (FIG. 10(*a*) and (*b*)). Thereafter, the candy A and wrapping paper B are raised by a substantially linear ascending motion of the pushup arm 25 and pressor arm 34 and in keeping time with this movement, the open fork hand 53*a* descends in an arcuate path.

In synchronization with the ingress of the candy A and wrapping paper B into the open fork hand 53*a*, the engaging member 63*a* of the fork hand 53*a* is disengaged from the engaging member 56 of the rotary arm 54 so that the candy and wrapping paper are supported by the fork hand 53*a* (FIG. 13(*a*)–(*c*)). The pushup arm 25 then begins to descend, while the pressor arm 34 continues ascending further, diverts itself to the left-hand side of FIG. 13(*e*) clearing the top of the first digit 67 of the fork hand 53 and thereafter descends fast (FIG. 13(*d*)–(*e*)).

Thus, in accordance with this invention, the candy is supported from top and bottom by the pushup arm 25 and pressor arm 34 and taken out in an upward direction in the same path of movement. Therefore, compared with the prior art machine in which the candy is fed out horizontally and supported by the biasing force of a push-back bar of a fork hand, the action of taking out the candy is remarkably stablized so that a high speed operation is assured. Thus, even when the candy is ellipsoidal, for instance, it can be quickly taken out in stable posture without the risk of dropping it partway. Moreover, the paths of movement of the pushup arm 25 and pressor arm 34 are determined by the continuous rotary motions of the first crank 21, second crank 27 and third crank 28, the actions are smooth compared with the cam mechanism so that a high speed wrapping operation with reduced vibrations and noise is realized. Furthermore, since the wrapping paper is supported by the wrapping paper holder arm 26, the wrapping paper B can be maintained correctly in the inverted U-shape illustrated in FIG. 10 even when the candy A is taken out at a high speed. Thus, in the absence of the wrapping paper holder arm 26, the wrapping paper B would be distorted as shown in FIG. 10(*c*) depending on the flexibility of paper B and the speed of candy takeout so that the wrapping paper may not be judiciously folded back with the swing lever 74 or the like member. Troubles such as this are completely eliminated.

When the fork hand 53 grips the candy, the wrapping paper B has just semi-wrapped the candy A in the inverted U-shape. While the fork hand 53 gripping the candy continues its counterclockwise rotation, one side of the wrapping paper B is folded back by the action of the swing lever 74 and the other side is folded back by the guide plate 73. Thereafter, the fork hand 53 continues rotating further but the twister hand (not shown) of the twister 6 spins and rotates in association with the fork hand 53 to twist both ends of the wrapping paper held by the fork hand 53. When the fork hand 53 has descended a short distance from its highest ascending position, the fork hand 53 is opened (FIG. 12) and in timed relation with this opening of the fork hand, the discharge pawl 71 flips out the wrapped product for discharge.

In the above operational sequence, the paper feeder 8 supplies a predetermined length of wrapping paper onto the aligning disk 10 in timed relation with the rotation of the aligning disk 10. Incidentally, when the wrapping paper is a synthetic resin film, it is not only low in rigidity but also ready to be electrostatically charged. Moreover, when the wrapping paper is paid out more or less horizontally from the drive roller 83, it tends to get adhered to the path of travel so that an error in cut dimension or a paper jam may take place. In accordance with this invention, however, compressed air is delivered from the air jet orifices 85*a* disposed close to the drive roller 83 in such a manner that a clearance is provided without fail between the wrapping paper and the path of travel so that a stable supply of wrapping paper is insured.

The above description pertains to an embodiment of this invention. It should be understood that many changes and modifications can be made by those skilled in the art without departing from the spirit of this invention. For example, the wrapping load is not limited to sweets such as candies, chocolates, etc. but the invention is applicable to any and all products that are generally supplied in twist-wrapped forms. There is no restriction on the shape of the load, either. Thus, cubic, spherical, ellipsoidal and nearly all other conceivable shapes may be dealt with. The terminal configurations of the pushup arm 25 and pressor arm 34 and the configurations of the rubber members 65*a*, 67*a* of the digits 65, 67 of fork hand 53 may be altered to suit the shape of the wrapping load.

The specific constructions and relative arrangement of the pushup mechanism 19 and pressor mechanism 20 can also be modified according to the desired paths of movement. Furthermore, the material for the wrapping paper is not particularly restricted, either. If the wrapping paper is a paper of high rigidity, the candy pushup means 24 need not be provided with the wrapping paper holder arm 26. Depending on the raw material of wrapping paper, the paper feeder 8 need not be provided with said air jet means 85. Moreover, a stop means for preventing the candy from dropping may be disposed at the bottom of the holding aperture 14 in the aligning disk 10. Then, depending on the shape of the wrapping load, the annular plate 11 may be omitted.

What is claimed is:

1. A twist-wrapping machine comprising an aligner means for orienting a plurality of units of a wrapping load individually, a takeout means for taking out the wrapping load from said aligner means, a paper feeder for supplying a wrapping paper adjacently of the load taken out by said takeout means, a fork means for gripping the load and accompanying wrapping paper, a twister for twist-wrapping both free ends of the wrapping paper while it is so gripped, and a discharge means for ejecting the twist-wrapped load, said aligner means having a rotary disk adapted to rotate intermittently within a horizontal plane and equipped with holding apertures for accommodating the load, said takeout means having a pushup member adapted to move in a path of movement passing through said holding apertures and a pressor arm adapted to press down the load on the pushup member from above, and said pushup means being independent of said fork means and said pressor arm moving in association with said pushup means to eject the load in an upward direction.

2. The twist-wrapping machine according to claim 1 wherein said pushup member and pressor arm are driven in optional paths of movement by crank mechanisms.

3. The twist-wrapping machine according to claim 2 wherein the path of movement of said pressor arm is constituted by a crank mechanism insuring a linear vertical motion and an auxiliary crank mechanism insuring a swinging motion which is substantially normal to said vertical motion.

4. The twist-wrapping machine according to claim 1 wherein said pushup member of takeout means is provided with a pushup arm for supporting the load thereon and pushing it up, the terminal end of the pushup arm constituting a hollow cylinder.

5. The twist-wrapping machine according to claim 1 wherein said pushup member of said takeout means comprises a pushup arm for supporting the load thereon and pushing it up and a wrapping paper holder arm adapted to support the wrapping paper supplied on top of the load on the lateral sides of said pushup arm.

6. The twist-wrapping machine according to claim 1 wherein said aligner means comprises a stationary annular plate below said holding apertures and the load is oriented in a predetermined position by the relative movement of said stationary annular plate and said rotary disk.

7. The twist-wrapping machine according to claim 6 wherein said aligner means is further provided with a rotary brush adapted to turn in a direction counter to the direction of advance of said rotary disk and the rotary brush contracting the load assists in the orienting of the load.

8. The twist-wrapping machine according to claim 1 wherein said aligner means is provided with a parasol-shaped disk covering the top of said rotary disk and the accommodation of the load into said holding apertures is rendered smooth by a continuous rotation of said parasol-shaped disk at a speed higher than the speed of said rotary disk.

9. The twist-wrapping machine according to claim 1 wherein said paper feeder is adapted to supply the wrapping paper in a substantially horizontal direction onto the top of the wrapping load pushed up by said pushup member.

10. The twist-wrapping machine according to claim 1 wherein said paper feeder is equipped with air jet means in the path of feed of said wrapping paper in such a manner that the jets of air delivered therefrom assist in the supply of the wrapping paper.

11. The twist-wrapping machine according to claim 1 wherein said discharge means comprises a set of revolving discharge pawls adapted to eject the load in coincidence with release of the grip of said fork means on the load.

12. The twist-wrapping machine according to claim 11 wherein said discharge means comprises three discharge pawls revolving at a uniform speed and is so adapted that when a first discharge pawl pushes the twist-wrapped load, the remaining pawls push the wrapping paper at the same time.

* * * * *